US006464164B1

(12) United States Patent
Cox et al.

(10) Patent No.: US 6,464,164 B1
(45) Date of Patent: Oct. 15, 2002

(54) TOOL FOR SUPPORTING AND APPLYING WALLPAPER BORDER MATERIAL

(76) Inventors: Jeffrey J. Cox, 2133 Nevada, Liberal, KS (US) 67901; Shirley R. Cox, 2133 Nevada, Liberal, KS (US) 67901

( * ) Notice: Subject to any disclaimer, the term of this patent is extended or adjusted under 35 U.S.C. 154(b) by 0 days.

(21) Appl. No.: 09/479,554

(22) Filed: Jan. 7, 2000

(51) Int. Cl.[7] ..... B65H 49/00; B65H 75/18; B44C 7/06

(52) U.S. Cl. ..... 242/588.2; 156/577; 242/597.8

(58) Field of Search ..... 242/588.1, 588.2, 242/597.8; 156/577, 579

(56) References Cited

U.S. PATENT DOCUMENTS 5,094,395 A * 3/1992 Lambert ..... 242/588.2 X
5,125,609 A * 6/1992 Demeo ..... 242/597.8 X
5,403,430 A * 4/1995 Araujo et al. ..... 156/579 X
5,478,432 A * 12/1995 Vester ..... 156/579 X
5,743,485 A 4/1998 Martorelli et al. ..... 242/597.7
5,775,633 A 7/1998 Zane ..... 242/599.1

* cited by examiner

*Primary Examiner*—Michael R. Mansen
(74) *Attorney, Agent, or Firm*—Seed IP Law Group, PLLC

(57) ABSTRACT

A tool for supporting and applying wallpaper border material to the surface of a structural member is provided. The tool includes a handgrip, a support post, and a mounting post projecting from a longitudinal member, with the handgrip, support post, and mounting post integrally formed with the longitudinal member and in spaced parallel relationship to one another. The mounting post includes a substantially flat, planar surface for bearing against the surface of the support structure. One or more pins project from the flat surface at a slight angle to provide increased load-bearing capacity. The handgrip includes a substantially smooth surface with a straight portion to use in smoothing the wallpaper after it is applied to the surface of the structural member.

21 Claims, 4 Drawing Sheets

TOOL FOR SUPPORTING AND APPLYING WALLPAPER BORDER MATERIAL

TECHNICAL FIELD

The present invention pertains to a tool for wallpaper borders, and more particularly, to a tool for supporting and applying a roll of wallpaper border material on a structural surface.

BACKGROUND OF THE INVENTION

Wallpaper borders are relatively narrow, decorative strips of wallpaper material for applying to the surfaces of walls, ceilings, and similar structures. Such borders may be applied over unpainted and painted surfaces, as well as over other wallpaper. An adhesive agent applied on either the surface to be covered or to the wallpaper border material, or a self-adhesive material formed on the wallpaper border material, bonds the wallpaper border material to the structure.

When wallpaper border material is supplied to consumers, it is typically formed into a roll. Application of the wallpaper border typically requires two people, one to hold and dispense the wallpaper border material and the other to apply the wallpaper border material to a surface. Although one person can apply the wallpaper border, it is a difficult task, at best, to both hold and dispense the material while applying it. Previous attempts to design a tool to facilitate supporting the roll of wallpaper border material on the wall have resulted in cumbersome; complicated devices that are difficult to use and expensive to manufacture.

For example, U.S. Pat. No. 5,775,633 entitled "Wallpaper Border Roll Holder," discloses a tool having a fixed bottom spike and a spring-loaded top spike for attaching the tool to both a wall and a ceiling. A plate attached to the top of the tool with fasteners holds the movable spike in place. The disadvantage here is that the tool must be applied to both the ceiling and the wall, and it requires movable, spring-loaded parts.

U.S. Pat. No. 5,743,485, entitled "Wall Surface-Attachable Tool for Hands-Free Support of Roll of Wallpaper Border," discloses a generally L-shaped elongate body having probe elements for attachment to a structural member and an L-shaped rod spaced apart from the elongate body member to receive the roll of wallpaper. Standoff sleeves projecting from the elongate body position the tool a predetermined distance from a wall surface. In essence, the device is designed as a pry bar, and if extreme care is not taken in mounting and removing it from a wall surface, a rather large piece of the surface and supporting substrate can be removed. The close proximity of the probe elements to each other also makes the device unstable when mounted to a wall surface.

SUMMARY OF THE INVENTION

The present invention is directed to a tool that supports a roll of wallpaper border material on a structure and facilitates application of the wallpaper border material to the structure. In one embodiment, the tool has a handle with a handgrip and integrally formed hand guard; a support post integrally formed with and projecting from the handle; and a mounting member integrally formed with and projecting from the support post, the mounting member configured to releasably mount the tool to the structure and the support post configured to support a roll of wallpaper border material.

In accordance with another aspect of the present invention, the mounting member includes a post and one or more mounting devices associated with the post for removably mounting the tool to the structure. Ideally, the post has a mounting surface that is substantially planar for bearing against the structure, and the mounting device comprises one or more spikes projecting from the mounting surface for manual insertion into the structure. Ideally, the post has a top and bottom, and the spikes are angled down towards the bottom of the post to increase the load-bearing capacity of the tool.

In accordance with yet another aspect of the present invention, the spikes projecting from the post are located on the post such that holes remaining in the structure when the spikes are removed will be covered by the wallpaper border material.

In accordance with another embodiment of the present invention, a tool for supporting a roll of wallpaper border material on a structure is provided. The tool includes a longitudinal member having first and second ends, a first projection extending from the longitudinal member; a second projection extending from the longitudinal member in the same direction as the first projection and including a mounting device to enable removable mounting of the tool to the structure; and a third projection extending from the longitudinal member in the same direction as and located between the first and second projections, the third projection configured to support a roll of wallpaper border material. Ideally, the longitudinal member is integrally formed with the first, second, and third projections, with the first, second, and third projections formed at substantially a right angle to the longitudinal member and in space parallel relationship to one another.

In accordance with another aspect of the present invention, the tool further includes a fourth projection extending from the longitudinal member in the same direction as and located between the first and third projections. Preferably, the first and fourth projections are connected together by a cross-member that is integrally formed with the first and fourth projections.

In accordance with a further aspect of the present invention, the third projection has a planar face that is configured to bear against the structure member and includes one or more mounting devices extending from the planar face. Ideally, the mounting devices comprise spikes, with at least two spikes in one embodiment, that extend from the planar face.

In accordance with yet a further aspect of the present invention, the planar face has a top and a bottom, and the spikes project from the planar face to angle toward the bottom of the planar face to increase the load-bearing capacity of the device when attached to the wall.

In accordance with yet another aspect of the present invention, the first projection has a substantially smooth surface with a substantially straight portion to enable use of the first projection in smoothing the wallpaper border material as it is applied to the surface of the structural member.

BRIEF DESCRIPTION OF THE DRAWINGS

The following description of the disclosed embodiments of the invention will be more easily understood when taken in conjunction with the following drawings, wherein.

DETAILED DESCRIPTION OF THE INVENTION

Figure 1:
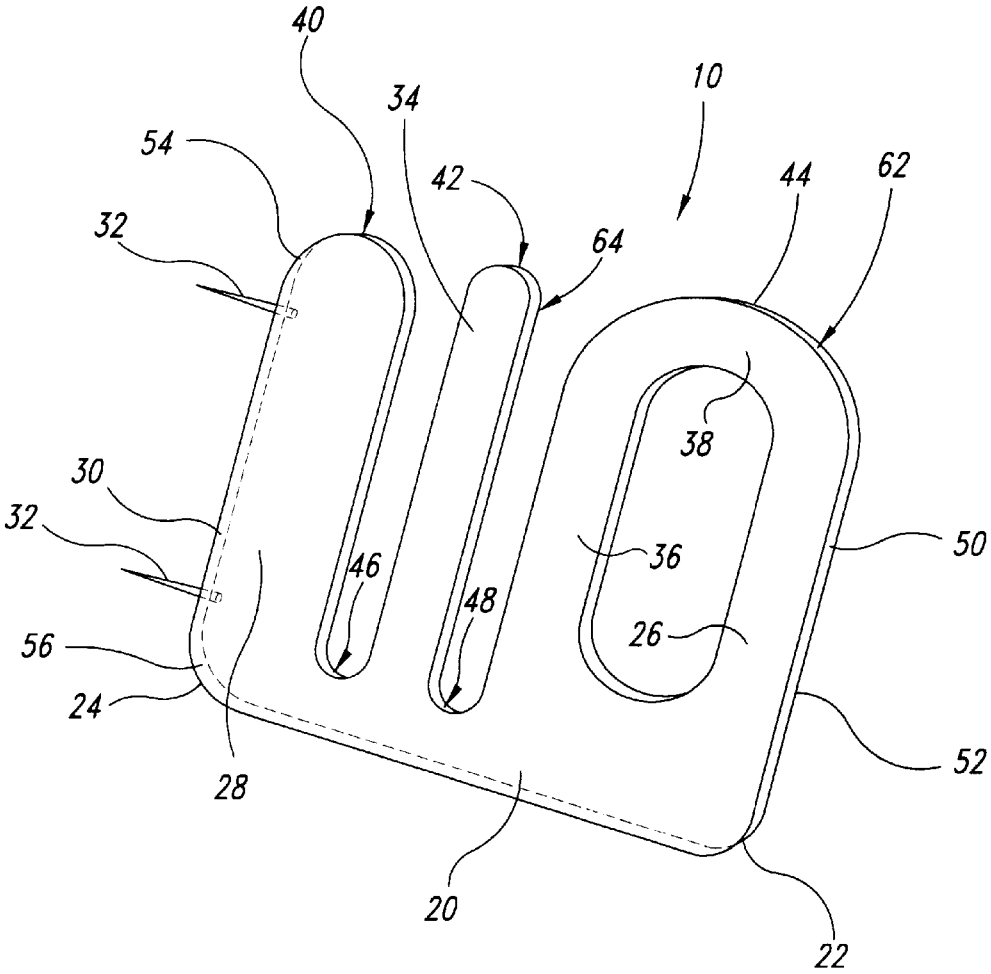
FIG. 1 is an isometric projection of a tool formed in accordance with the present invention.
Figure 2:
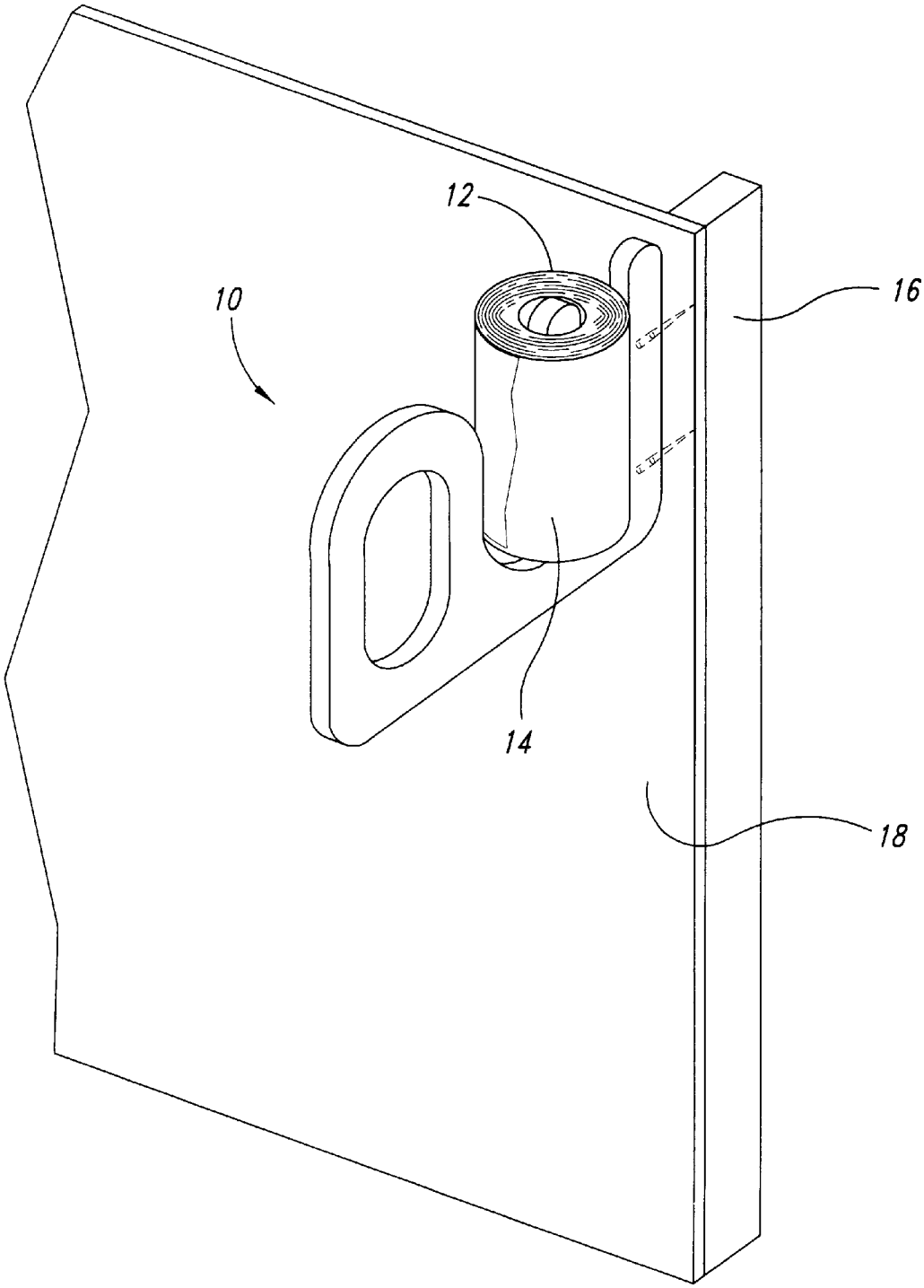
FIG. 2 is a side view of the tool of FIG. 1 mounted on a structure.

Referring initially to FIGS. 1 and 2, shown therein is a tool 10 formed in accordance with the present invention. The tool 10 is designed to be used in conjunction with a roll 12 of wallpaper border material 14 and a structural member 16. The wallpaper border material 14 is commercially available to consumers, and is typically supplied in a roll 12, as shown in FIG. 2. As discussed above, it is applied to a surface 18 of the structural member 16 with either adhesive to the surface 18 or to the wallpaper border material 14, or the wallpaper border material 14 is supplied with a self-adhesive on one surface.

Figure 3:
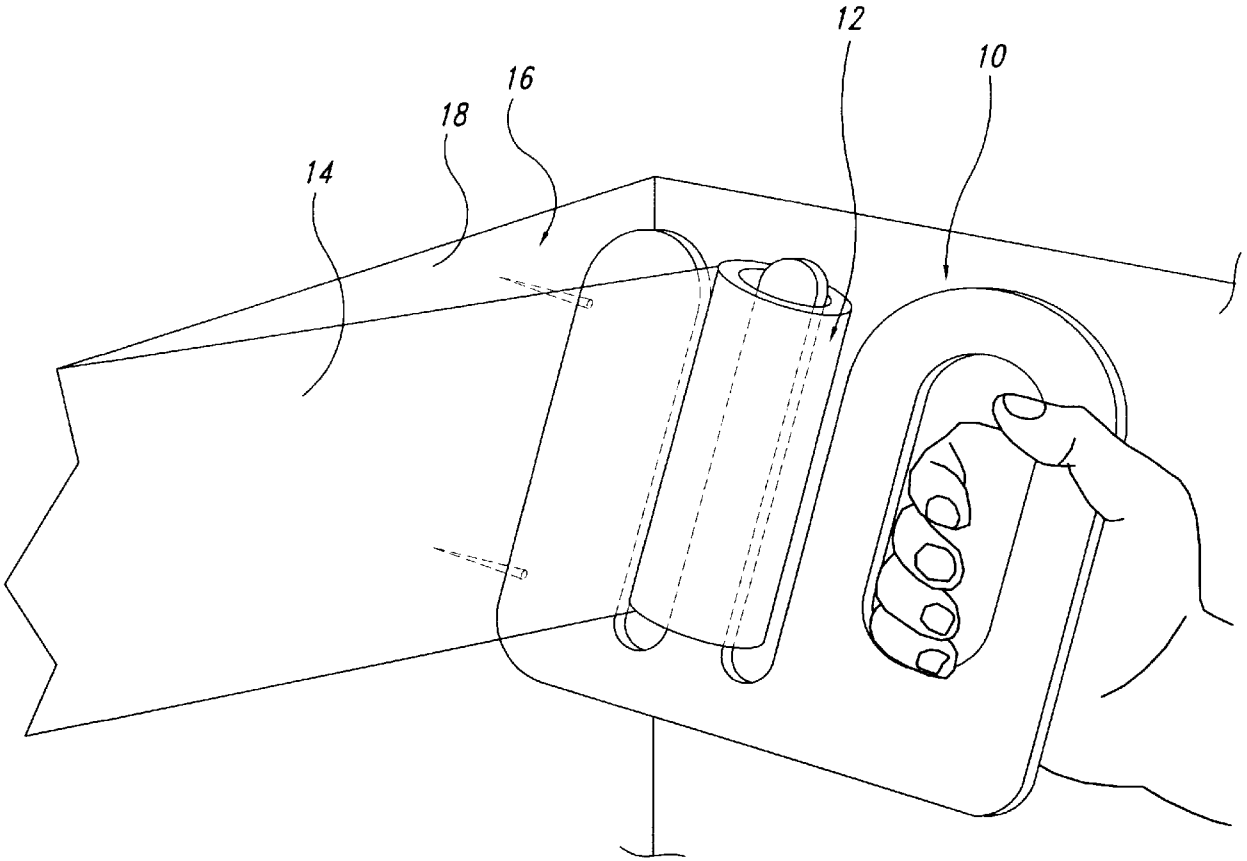
FIG. 3 is an isometric projection illustrating use of the tool formed in accordance with the present invention.

In accordance with one embodiment of the invention, the tool 10 is formed from a longitudinal member 20 having first and second ends 22, 24, respectively, with a first projection 26 extending from the first end 22 and a second projection 28 extending from the second end 24. The first projection 26 is sized and shaped to form a handgrip to be grasped by a user, as shown in FIG. 3. The second projection 28 includes a substantially flat, planar face 30 and a pair of spikes 32 projecting therefrom. In the embodiment shown in FIG. 1, the spikes 32 extend substantially at a right angle from the face 30 of the second projection 28.

A third projection 34 extends from the longitudinal member 20 between the first and second projections 26, 28 and is sized and shaped to function as a support post for the roll 12 of wallpaper border material 14. A fourth projection 36 also extends from the longitudinal member 20 and is connected to the first projection 26 by a cross-member 38. Thus, the first projection forms a handgrip while the second projection 36 in conjunction with the cross-member 38 forms a hand guard to protect the user's hand from the adjacent wallpaper and to provide structural support for the tool, maintaining the rigidity of the tool in use.

In one embodiment, the tool 10 is formed as a single, integral unit, i.e., the first, second, third, and fourth projections 26, 28, 34, 36 are integrally formed with the longitudinal member 20, and the cross-member 38 is integrally formed with the first and fourth projections 26, 36. As can be seen in FIG. 1, the first projection 26, second projection 28, and fourth projection 36 are substantially wider than the third projection 34 to increase the strength of the tool 10. Ideally, the ends 22, 24 of the longitudinal member a free end 40 of the second projection 28, a free end 42 of the third projection 34, and an exposed end 44 of the cross-member 38 are rounded, as are the internal surfaces 46, 48, between the second projection and the third projection, and between the third projection and the fourth projection, respectively, as shown in FIG. 1. The tool 10 is preferably formed from a single piece of plastic, such as polyethylene or polypropylene, which enhances its simplicity and ease of manufacture.

In accordance with another embodiment of the invention, the first projection 26 has an exposed surface 50 that is substantially smooth and includes a straight portion 52 between the longitudinal member 20 and the cross-member 38 that can be used to smooth the wallpaper border material 14 after it is applied to the surface 18. Also, in accordance with yet another embodiment of the present invention, the planar surface 30 has a top end 54 and a bottom end 56, and the spikes 32 are angled toward the bottom end 56 of the planar face 30, as shown more clearly in FIG. 2, to increase the load-bearing capacity of the tool 10.

Figure 4:
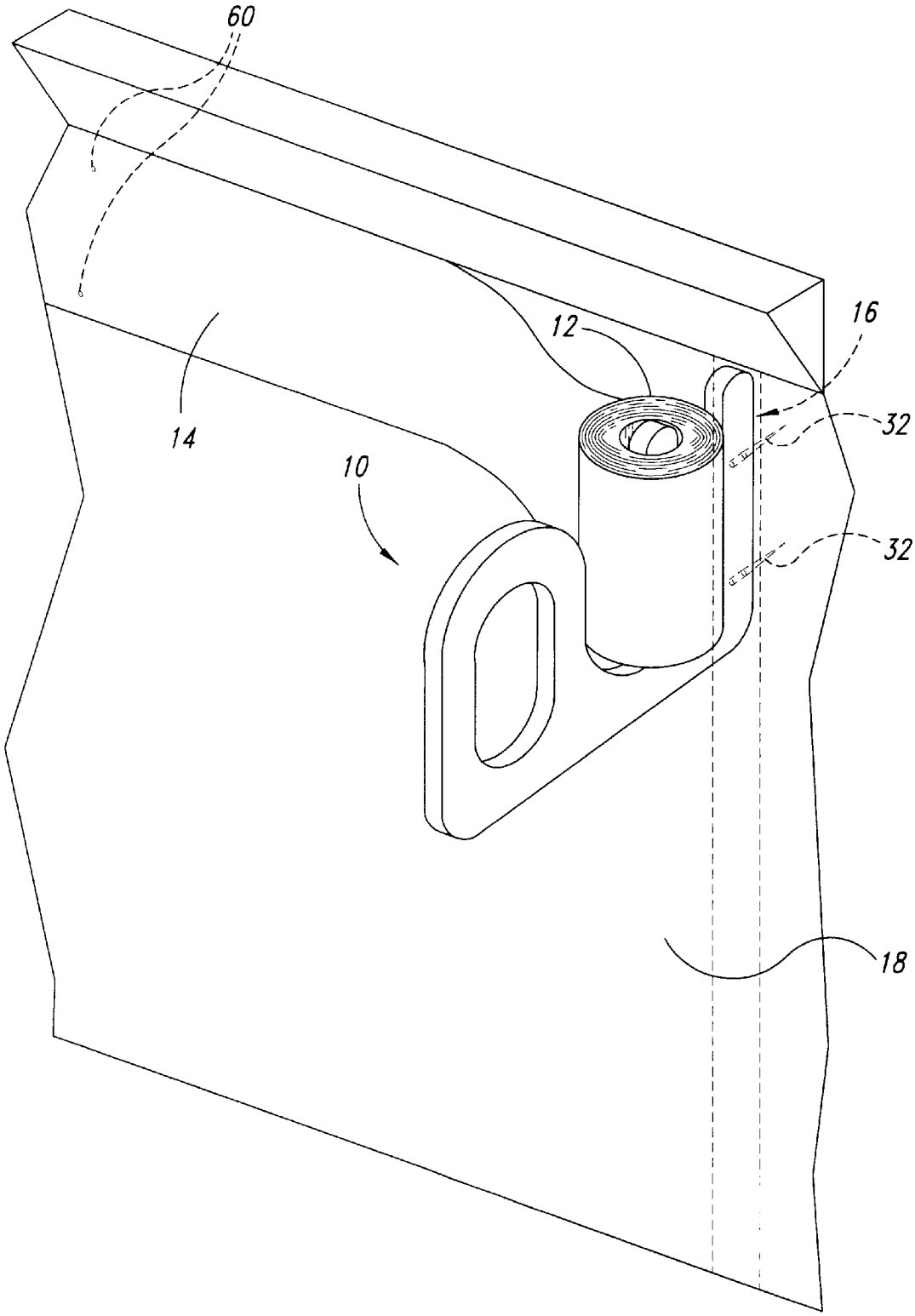
FIG. 4 is an isometric projection of a tool formed in accordance with the present invention supporting a wallpaper border roll on a structural member.

The roll 12 of wallpaper border material 14 is placed over the third projection 34, which functions as a support post. The wallpaper border material 14 is then unrolled and the tool 10 is positioned adjacent the structural member 16. The user grasps the hand grip, first projection 26, and forcibly inserts the spikes 32 through the surface 18 of the structural member 16 such that the substantially flat, planar surface 30 of the second projection 28 bears against the surface 18 of the structural member 16, as shown in FIGS. 2 and 3. With the wallpaper border roll 12 supported on the structural member 16, the wallpaper border material 14 is then applied to the surface 18 of the structural member 16, as shown in FIG. 4. Ideally, the spikes 32 extending from the planar surface 30 are located such that when the tool 10 is removed from the structural member 16, the holes 60 left in the surface 18 by the spikes 32 will be covered by the wallpaper border material 14, as shown in FIG. 4.

The tool 10 is also compatible for use with both self-adhesive wallpaper material 14 and wallpaper material 14 that must be wetted prior to application. For example, a pre-pasted wallpaper border material 14 is wetted and rolled in reverse into a circular tube 12 onto itself. With one hand, a user grasps the handgrip 62 and presses it into proper position on the surface 18 of the wall or structural member 16. The wallpaper border material 14 is pulled from the roll 12 and pressed to its proper position on the surface 18 with the user's free hand. Tension is supplied by the friction of the wet or dry wallpaper border material 14 on the support post 64. As the wallpaper border material 14 is being applied, the flat surface 50 of the handle 62 can be used to smooth the wallpaper border material 14 that has already been hung.

When the user installing the wallpaper border material 14 runs out of room to safely hang it, he or she simply places the tool 10 with the steel pins 32 toward the wall surface 18 and gently pushes the pins 32 into the surface 18. The structural member may be formed from sheet rock or plaster. In order to remove the tool 10, a slight upward pull is required to remove the angled pins 32.

In accordance with another embodiment of the invention, the tool 10 is manufactured from a single piece of ¼-inch polycarbonate plastic with two hardened steel support pins 32 bonded into the edge 30 of the tool 10. When extruded or routed, the handle portion 62 formed by the first projection 26, second projection 36, cross-member 38, and first end 22 of the longitudinal member 20 is shaped to fit most hands for comfort of use. The second projection 28 contains the hardened-tempered steel support pins 32 installed at slight angles to 90° to enable the tool to be mounted on the wall in which the wallpaper border material 14 is being hung. Only the vertical wall surface is required to hold the tool and the roll 12 of wallpaper border material 14. No attachment of any kind to the ceiling is required. The tempered steel support pins 32 are located in such a manner that once the tool 10 is removed from its attachment with the surface 18 of the wall or structural member 16, the small pierce marks 60 remaining are easily covered by the wallpaper border material 14 being installed.

One of the major advantages of the tool is the ease in cleaning and storing. It lays flat in a tool case or chest and can be hung from a tool belt or placed in an apron with other wallpaper hanging tools without being encumbered by size or bulkiness. Because there are no moving parts, the life of the product is extended indefinitely. With rounded comers on all sides, the tool 10 is not apt to be chipped or damaged from dropping it or placing it in a tool storage compartment.

While various embodiments of the invention have been illustrated and described herein, it is to be understood that various changes may be made without departing from the spirit and scope of the invention. Hence, the invention is to be limited only by the scope of the claims that follow.

What is claimed is:

1. A tool for holding a roll of wallpaper border material, comprising:

a handle having a handgrip and integrally formed hand guard extending from a first end of a longitudinal member;

a support post integrally formed with and extending from the longitudinal member in the same direction as the handle; and a mounting member integrally formed with and extending from the longitudinal member in the same direction as the support post, the mounting member configured to releasably mount the tool to a structural member and the support post configured to support the roll of wallpaper border material.

2. The tool of claim 1, wherein the mounting member comprising a mounting post and at least one mounting device associated therewith for removably mounting the tool to the structural member.

3. The tool of claim 2, wherein the mounting post comprises a mounting surface for bearing against the structural member and the mounting device comprises at least one spike projecting from the mounting surface for manual insertion into the structure.

4. The tool of claim 2, wherein the mounting post has a mounting surface for bearing against the structural member, and the mounting device comprises at least one spike projecting from the mounting surface, the mounting post having a top and a bottom, and the at least one spike angles toward the bottom of the mounting post.

5. The tool of claim 4, wherein the at least one spike is located on the mounting post such that holes remaining in the structural member when the at least one spike is removed will be covered by the wallpaper border material.

6. A tool for supporting a roll of wallpaper border on a structure, the tool comprising:

a body having a first end with a hand-holdable member extending from the body in a first direction, a second end with a structure-attachment member extending from the body in the first direction, and an intermediate area formed between the first and second ends with a support post extending therefrom in the first direction and configured to support the roll of wallpaper border material; the hand-holdable member, the structure-attachment member, the support post, and the intermediate area all integrally formed with the body from a single piece of material.

7. The tool of claim 6 wherein the hand-holdable member comprises a handgrip configured for grasping by a user.

8. The tool of claim 7 wherein the hand-holdable member further comprises a hand guard.

9. The tool of claim 8 wherein the handgrip comprises a smooth exterior surface with a substantially straight portion configured to be usable in smoothing the wallpaper border material on the structure.

10. The tool of claim 6 wherein the structure-attachment member has a substantially planar exposed surface to bear against the structure, the structure-attachment member further comprising at least one attachment device for removably mounting the tool to the structure.

11. The tool of claim 10 wherein the at least one attachment device projects from the exposed surface of the structure-attachment member and are positioned such that at least one hole formed in the structure by the at least one attachment device is covered by the wallpaper border material when the tool is removed.

12. The tool of claim 10 wherein the at least one attachment device comprises at least one spike.

13. The tool of claim 12 wherein the exposed surface of the structure attachment member has a top end and a bottom end, and wherein the at least one spike projects out from the exposed surface and is angled toward the bottom end of the exposed surface to provide greater load-bearing capacity when removably mounted on the structure.

14. A tool for supporting and applying a roll of wallpaper border material to the surface of a structure, comprising:

a longitudinal member having first and second ends;

a first projection extending from the longitudinal member at one of the first and second ends;

a second projection extending from the other of the first and second ends of the longitudinal member in the same direction as the first projection and including a mounting device to enable removable mounting to the structure; and a third projection extending from the longitudinal member in the same direction as and located between the first and second projections, the third projection configured to support a roll of wallpaper border material.

15. The tool of claim 14 wherein the first, second, and third projections are in spaced parallel relationship and project at substantially a right angle from the longitudinal member.

16. The tool of claim 15 further comprising a fourth projection extending from the longitudinal member in the same direction as and located between the first and third projections.

17. The tool of claim 16 wherein the first and fourth projections are connected by a cross-member that is integrally formed with the first and fourth projections.

18. The tool of claim 15 wherein the second projection comprises a planar face configured to bear against the surface of the structure and at least one mounting device extending from the planar face.

19. The tool of claim 18 wherein the at least one mounting device comprises at least one spike extending from the planar face.

20. The tool of claim 19 wherein the planar face has a top and a bottom, and further wherein the at least one spike is angled toward the bottom of the exposed face to increase load-bearing capacity of the tool when attached to a structure.

21. The tool of claim 15 wherein the first projection has a smooth surface with a straight portion to enable a user to use the smooth surface in smoothing the wallpaper border material as it is applied to the structure.

* * * * *